US006265010B1

(12) United States Patent
Franco

(10) Patent No.: US 6,265,010 B1
(45) Date of Patent: Jul. 24, 2001

(54) METHOD AND DEVICE FOR PREPARING A DRINK GLASS

(76) Inventor: Richard E. Franco, 121 SW. 5th Ct., Pompano Beach, FL (US) 33308-3585

( * ) Notice: Subject to any disclaimer, the term of this patent is extended or adjusted under 35 U.S.C. 154(b) by 0 days.

(21) Appl. No.: 09/443,419

(22) Filed: Nov. 19, 1999

(51) Int. Cl.[7] ..... A23L 1/22; B65D 81/36

(52) U.S. Cl. ..... 426/420; 426/132; 426/590; 426/592

(58) Field of Search ..... 426/420, 132, 426/489, 649, 616, 592, 590

(56) References Cited

U.S. PATENT DOCUMENTS

| | | | | |
|---|---|---|---|---|
| D. 291,181 | * | 8/1987 | Franco | D9/428 |
| 1,757,609 | * | 5/1930 | Beardsley et al. | 99/505 |
| 2,057,227 | * | 10/1936 | Blum | 99/505 |
| 5,370,884 | * | 12/1994 | Coleman | 426/112 |
| 5,743,423 | * | 4/1998 | Franco | 220/23.86 |

OTHER PUBLICATIONS

Bell Boy Supplies Home Page, see add for Margarita salt #MIX23562, http://www.bellboycorp.com, Aug. 1997.*

Freshies com, What's Shakin Page, add for colored salts, http://www.freshies.com, Dec. 1998.*

C.R. Manufacturing Foodservice, Restaurant & Bar Supplies, Featured Products, add for Margarita Made Easy Glass Rimmer, http://www.crmfg.com, Jul. 2000.*

* cited by examiner

*Primary Examiner*—Milton Cano
*Assistant Examiner*—Sherry A. Dauerman
(74) *Attorney, Agent, or Firm*—Oltman, Flynn & Kubler

(57) ABSTRACT

A method and a device for preparing a drink glass with a salt-coated rim in which juice from a lime or lemon is deposited in an open-topped recess formed in the top of a lid for a wide-mouthed salt container, and the drink glass is inverted down onto the lid to have its rim wetted by the juice before being dipped into salt in the container.

3 Claims, 2 Drawing Sheets

METHOD AND DEVICE FOR PREPARING A DRINK GLASS

BACKGROUND OF THE INVENTION

This invention relates to a novel method and a novel device for preparing a drink glass with a salt-coated rim, particularly for a margarita cocktail.

The well known margarita cocktail is made of tequila liquor, an orange-flavored liqueur, and lime or lemon juice. It is usually served in a glass whose rim is treated with salt. For this purpose, it is a known practice to provide a wide-mouthed salt container into which the wet rim of an inverted drink glass is inserted to pick up a coating of salt before the margarita cocktail is added. One salt container used for this purpose has a removable lid that is sombrero shaped to suggest the Mexican origin of the desert plant from which the tequila liquor is distilled.

BRIEF SUMMARY OF THE INVENTION

The present invention is directed to a novel method of preparing a drink glass with a salt-coated rim and to a novel salt container lid for use in a preferred embodiment of that method.

In accordance with the method of this invention, lime juice or lemon juice is squeezed into a shallow open-topped recess formed in the salt container lid, and the rim of an inverted drink glass is dipped into this juice to be wetted by it before being dipped into the salt in the container. The container lid may be in the shape of a sombrero with a shallow, annular, open-topped recess surrounding the crown, or the lid may be generally flat with a shallow, annular, open-topped recess, for the purpose of holding lime juice or lemon juice into which the rim of the drink glass may be dipped. In accordance with the preferred embodiment of this invention, the crown of a generally sombrero-shaped lid for a salt container has a novel externally ribbed construction designed to have a half-lime or a half-lemon squeezed against it to cause the juice to run down into the open-topped annular recess below.

A principal object of this invention is to provide a novel and improved method of preparing a drink glass for use with its rim coated with salt.

Another primary object of this invention is to provide a novel salt container lid for use in practicing the method of the present invention.

Further objects and advantages of this invention will be apparent from the following detailed description of presently-preferred embodiments with reference to the accompanying drawings.

DETAILED DESCRIPTION OF THE PRESENT INVENTION

Before explaining the present invention in detail it is to be understood that the invention is not limited in its application to the particular arrangements shown and described since the invention is capable of other embodiments. Also, the terminology used herein is for the purpose of description and not of limitation.

Figure 1:
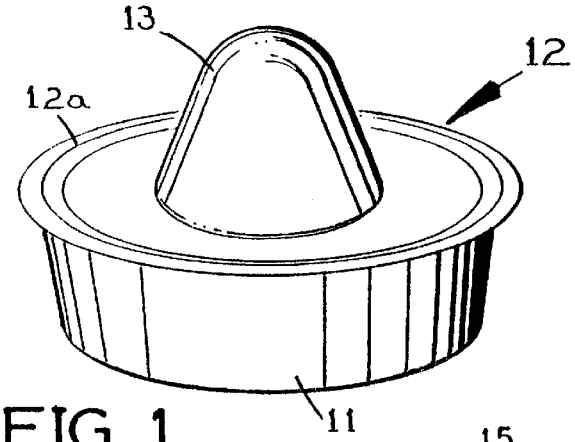
FIG. 1 is a perspective view of a wide-mouthed salt container for margarita salt provided with a sombrero-shaped lid in accordance with the prior art.
Figure 2:
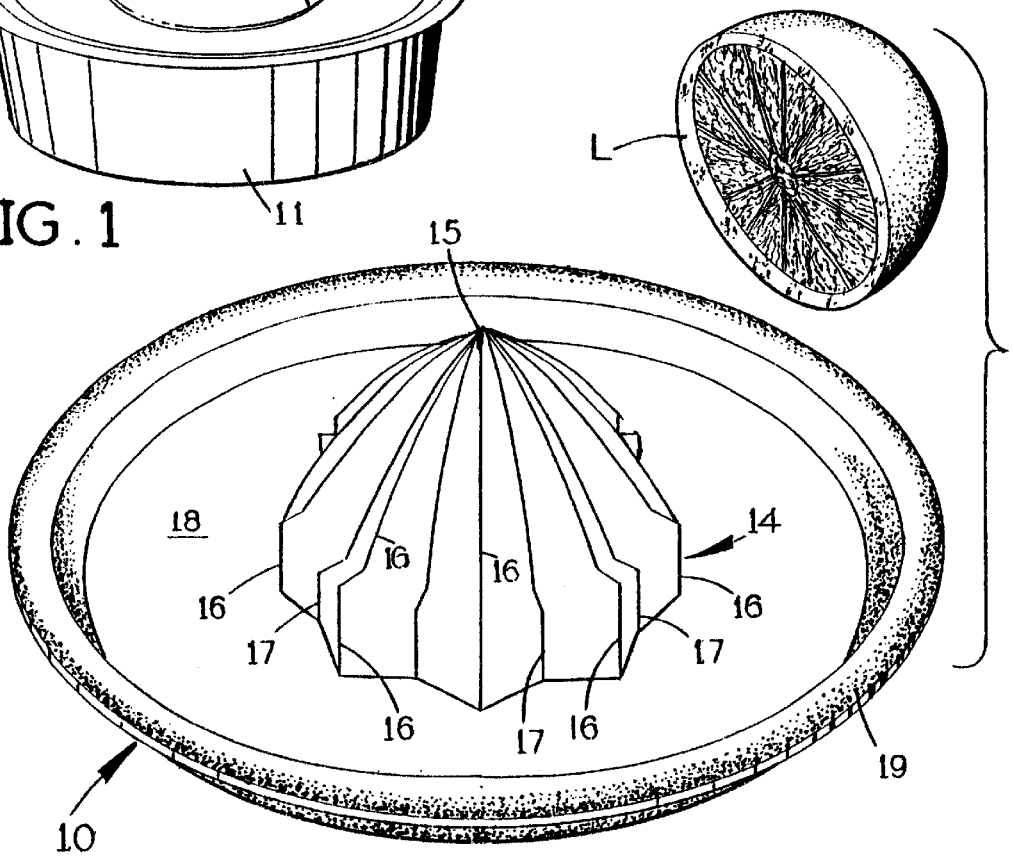
FIG. 2 is a perspective view of a salt container lid in accordance with one novel aspect of the present invention, for use in practicing the method of this invention.
Figure 3:
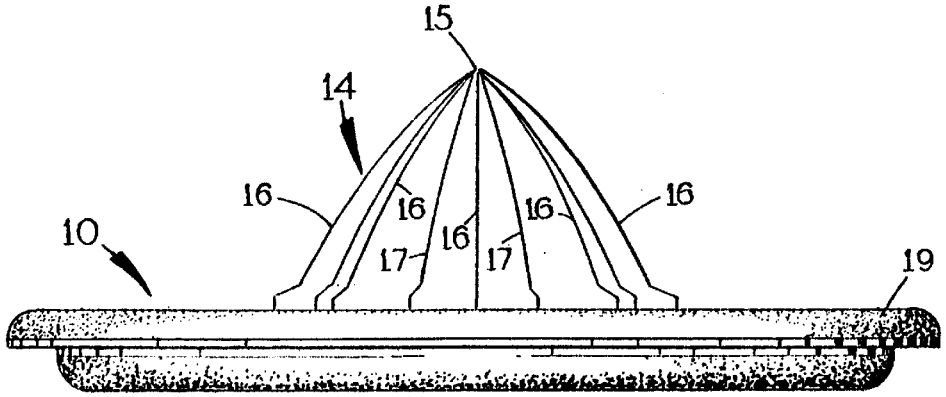
FIG. 3 is a front elevation of this lid.

Referring first to FIG. 2, the novel device shown there is a lid 10 for a wide-mouthed salt container of known design, shown at 11 in FIG. 1. There the salt container 11 has a sombrero-shaped lid 12 of known design with a smooth surfaced, tapered crown 13 that is rounded at the top. The container lid 10 of FIG. 2 is substantially identical to the prior art lid 12 of FIG. 1 and may be used the same way to close the top of salt container 11 except that lid 10 has a rounded, tapered crown that comes to a point 15 at the top and presents in succession circumferentially a plurality of outwardly-projecting, pointed ribs 16 and grooves 17 of V-shaped cross-section between the ribs which lead down into a shallow, open-topped, annular recess 18 formed in the lid between its ribbed crown 14 and its peripheral rim 19. The inside diameter of recess 18 in lid 10 is less than the inside diameter of the drink glass that is to be prepared for a margarita cocktail, and the outside diameter of recess 18 is greater than the outside diameter of the glass.

In accordance with the novel method of the present invention, a cut half of a lime or lemon L (FIG. 2) may be placed with its cut face down on the point 15 of the crown 14 of lid 10, and then pushed down over the crown to squeeze its juice into the grooves 17 in the crown. The juice then flows down into the annular recess 18 in the lid which surrounds the base of its crown 14. Thereafter, a margarita glass may be inverted over the crown 14 of lid 10 to bring the rim of the glass into contact with the lime juice or lemon juice in the lid recess 18 to wet this rim, after which the glass may be inverted down into the salt container 11 (with the lid removed) to pick up a coating of salt on the wet rim.

The novel method of the present invention may also be performed, although less advantageously, using the conventional salt container and sombrero lid arrangement shown at 11 and 12 in FIG. 1. First, the lime or lemon piece is squeezed manually to deposit juice in the lid between its crown 13 and its peripheral rim 12*a*, after which the rim of the drink glass may be wetted by this juice and then coated with salt, as described.

Figure 4:
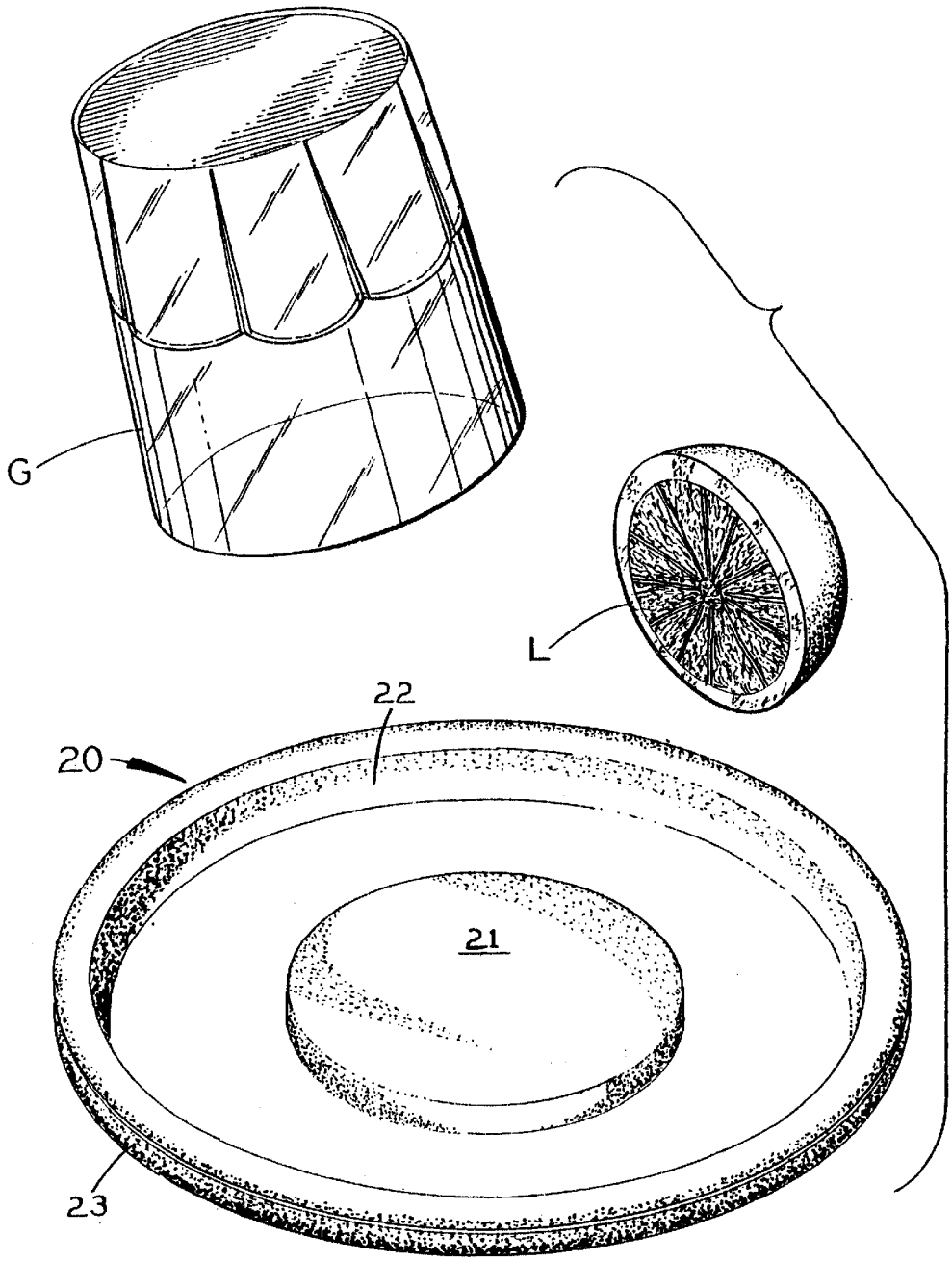
FIG. 4 is a perspective view of a generally flat salt container lid that may be used in practicing the method of the present invention.

The method of this invention also may be performed in conjunction with a generally flat lid for the salt container 11, as shown at 20 in FIG. 4. In some situations such a lid may be preferred to make it easier to stack a plurality of salt containers (with the lids on) for shipping or storage purposes. The lid 20 has a flat-topped, raised, central segment 21, a shallow annular recess 22 surrounding this central segment, and a peripheral rim 23 surrounding the recess 22. The inside diameter of recess 22 is less than the inside diameter of the drink glass G, and the outside diameter of recess 22 is greater than the outside diameter of the glass Lime juice or lemon juice may be squeezed manually into the lid recess 22, after which the drink glass may be inverted over the lid to wet its rim with juice in recess 22, and then inverted into the salt container to coat its rim with salt.

I claim:

1. A method of preparing a drink glass comprising the steps of:

providing a wide-mouthed, open-topped salt container having a lid with an open-topped recess therein and a central crown with ribs and grooves therein;

depositing citrus juice in said recess in the lid;

inverting the drink glass down onto said lid to bring the rim of the glass into contact with the juice in the lid recess to wet said rim;

and thereafter, with said lid removed from the salt container, inverting the drink glass into said container to bring the rim of the glass into contact with salt in the container to coat said rim.

2. A method according to claim 1, wherein said recess in said lid is annular and has an inside diameter less than the inside diameter of the rim of the drink glass and an outside diameter greater than the outside diameter of the rim of the glass.

3. A method of preparing a drink glass for a margarita cocktail comprising the steps of:

providing a wide-mouthed salt container with salt therein, and a lid for said container having a central, upwardly-projecting, tapered crown with a pointed tip at the top and a plurality of outwardly projecting, pointed ribs and grooves in succession circumferentially extending down from said pointed tip, said lid having an annular open-topped recess encircling the base of said crown;

forcing a cut piece of citrus fruit down over said crown to squeeze juice down into said annular recess in the lid;

inverting the drink glass down over said crown of the lid to bring the rim of the glass into contact with juice in said annular recess in the lid to wet said rim;

and thereafter, with said lid removed from the salt container, inverting the drink glass down into said salt container to bring the wet rim of the glass into contact with salt in the container for coating said rim.

* * * * *